US005738296A

United States Patent [19]

Wu

[11] Patent Number: 5,738,296

[45] Date of Patent: Apr. 14, 1998

[54] THREAD FEEDER WITH VERTICALLY-EXTENDABLE SPOOL PROTECTOR FOR KNITTING MACHINES

[75] Inventor: Sze-Tsang Wu, Taipei, Taiwan

[73] Assignee: Jen Hui Chen, Taipei, Taiwan

[21] Appl. No.: 747,609

[22] Filed: Nov. 13, 1996

[51] Int. Cl.[6] ..... B65H 57/18

[52] U.S. Cl. ..... 242/566; 242/595.1; 66/125 R

[58] Field of Search ..... 242/566, 594.1, 242/594.2, 595.1, 151, 18 DD; 24/339; 66/125 R

[56] References Cited

U.S. PATENT DOCUMENTS

| | | | |
|---|---|---|---|
| 912,170 | 2/1909 | Rittersbacher | 24/339 X |
| 1,505,220 | 8/1924 | Shay | 24/339 X |
| 1,907,841 | 5/1933 | Lewis | 242/566 X |
| 2,134,656 | 10/1938 | Breth | 242/595.1 |
| 2,621,868 | 12/1952 | Clark et al. | 242/566 X |
| 2,650,042 | 8/1953 | Markwood | 242/566 X |
| 2,887,281 | 9/1959 | Caufield | 242/566 |
| 3,510,033 | 5/1970 | Schramm et al. | 242/595.1 X |
| 4,309,120 | 1/1982 | Werthmann | 24/339 X |

*Primary Examiner*—John J. Calvert

[57] ABSTRACT

A spool protector with a vertically-extendable spool protector is provided. The vertically-extendable spool protector is extendable vertically to protect spools of various sizes from being flipped away from the rollers that support the spools. The spool protector includes a protection beam and a releasable fastening means for releasably securing the protection beam in desired positions. The releasable fastening means can be implemented in two embodiment. The first embodiment is a supportive piece having a pair of angled portions each forming a coupling hole therein and the second embodiment is composed of a securing frame and a screw mounted on said securing frame. When said releasable fastening means release the protection beam, the technician can freely adjust for a suitable position for the protection beam so as to protect spools of various sizes.

3 Claims, 4 Drawing Sheets

THREAD FEEDER WITH VERTICALLY-EXTENDABLE SPOOL PROTECTOR FOR KNITTING MACHINES

BACKGROUND OF THE INVENTION

1. Field of the Invention

This invention relates to thread feeders for knitting machines, and more particularly, to a thread feeder with a vertically-extendable; spool protector which can be used to protect a spool on the hitting machine from being flipped away so as to always keep the spool in operating position.

2. Description of Related Art

Thread feeder is a device for supply threads from a spool to a knitting machine for weaving fabrics. Conventionally, the spools on a thread feeder are of the type which is typically 400 grams in weight and about 14 to 15 cm in diameter. One prior art type of thread feeder is disclosed in U.S. Pat. No. 4,918,948 to Nuerk of German. Conventional thread feeders can protect the spools of the aforementioned weight and size in position. However, with the coming of a new type of spools which weights about 1 kg which is usually used interchangeable with the conventional type on the hiring machine, the conventional spool protector proves to be incapable for this new type of spool. This problem will depict in more details in the following with reference to FIG. 1.

The conventional thread feeder of FIG. 1 includes a base 100 and two rollers 101, 102. Four spools A1, A2, A3, A4 are positioned on the rollers 101, 10:. A pair of L-shaped spool protectors 201,202 are horizontally placed on the spools A1, A2, A3, A4 so as to brace and hold the same in position. The provision of these two L-shaped spool protectors 201, 202 prevents these spools A1, A2, A3, A4 from being flipped away from the rollers 101, 102. This type of spool protectors are devised specifically to protect spools of the old 400 g type. In FIG. 1, for example, the dimensions designated by D1, D2, D3, and D4 represent the diameters of the old type of spools of 400 g in weight. However, the new type of spools of 1 kg in weight are now available to provide a more capacity of threads on a single spool that allows the knitting machine to run continuously with a longer period without having to replace new spools in short times. This new type of spools can also be positioned on the knitting machine in place of the old 400 g type. When this is the case, however, the protection of this new type of spools on the knitting machine becomes a new problem. In FIG. 1, for example, the dimensions designated by D11, D12, D13, and D14 represent the diameters of the new types of spools of 1 kg, which is much greater than that of the old type of spools of 400 g.

To protect the new type of 1 kg spools from being flipped away from position, the old type of spool protectors 201, 202 should be modified in such a way as to move their fixing member 203 to the right (with respect to the top view of FIG. 1) and also to elongate their free end so as to cover the overall diameter range of D11, D12, D13, and D14 . However, conventional knitting machines typically come with a crowded inner space in which the spools are mounted. To do the foregoing, the fixing member 203 should be moved to a position already occupied by the pulley set 204. This makes the foregoing scheme not a feasible solution for protection of the large-size spools. There exists, therefore, a need for a new spool protector which can be installed in a crowded inner space in the hitting machine and which is vertically-extendable to protect spools of various sizes.

SUMMARY OF THE INVENTION

It is therefore a primary objective of the present invention to provide a vertically-extendable spool protector for a thread feeder which can be mounted near the bottom of the spools to be protected and extendable vertically upwards from the bottom for protection of large-size spools.

It is another objective of the present invention to provide a vertically-extendable new spool protector for protection of spools of various sizes which can be adjusted easily and effortlessly by the technician.

In accordance with the foregoing and other objectives of the present invention, a new and improved type of spool protector for knitting machines is provided. In particular, this new type of spool protector is vertically-extendable so as to adjust for protection of spools of various sizes. Two preferred embodiments of this vertically-extendable spool protector of the invention are disclosed.

In the first embodiment, the vertically-extendable spool protector includes a protection beam and a supportive piece having a middle portion grasping a fixed mounting piece and a pair of elastic angled portions each being formed with a coupling hole therein. These coupling holes allow the protection beam to penetrate therethrough. When subject to no external force, the angled portions are at a first position where the inner edge of the coupling holes urges forcibly against due to elasticity against the protection beam such that the protection beam is secured in position. When the angled portions are bent to a second position by an external force, the inner edge of the coupling holes urges no force against the protection beam, thereby releasing the protection beam for free vertical adjustment of position.

In the second embodiment, the vertically-extendable spool protector includes a protection beam and a releasable fastening device. The releasable fastening device includes a securing frame and a screw mounted on the securing frame. When the screw is fastened tight, the tail end of the screw urges the protection beam forcibly against the mounting piece such that the protection beam is secured in position; and when the screw is loosened, the protection beam is released for free vertical adjustment of position.

The vertically-extendable spool protector according to the present invention allows the technician to adjust vertically to a suitable position for the protection beam so as to protect spools of various sizes. Further, the adjustment is very easy to achieve.

BRIEF DESCRIPTION OF DRAWINGS

This invention can be more fully understood by reading the following detailed description of the preferred embodiments, with reference made to the accompanying drawings, wherein.

DETAILED DESCRIPTION OF PREFERRED EMBODIMENT

The spool 14 as described in this specification hereinafter may be referred a kind of bobbin, or yarn package, or yam cake. To simplify the description of the present invention, the term of "spool" is represented in below.

Figure 1:
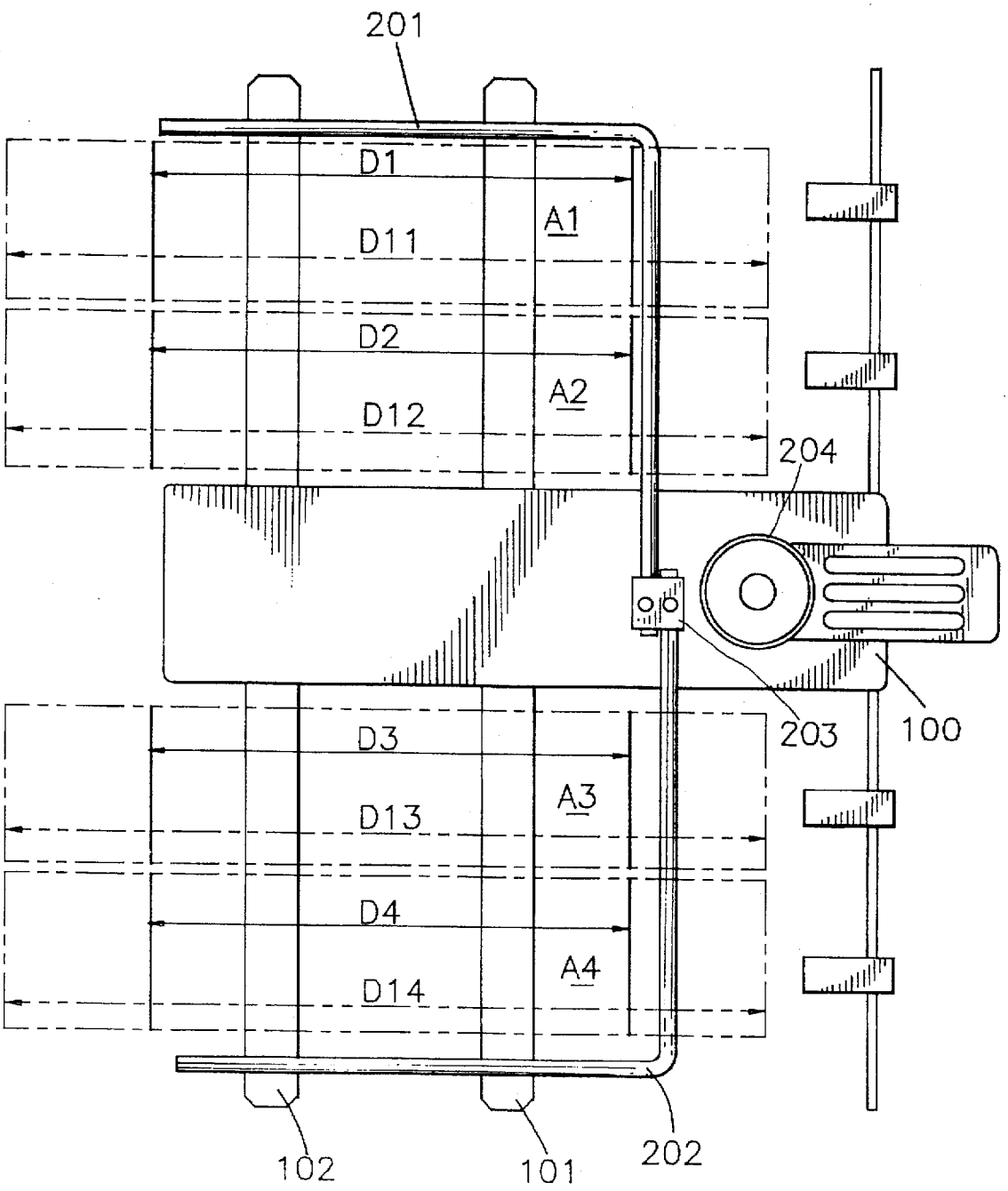
FIG. 1 shows a schematic top view of a conventional thread feeder.
Figure 2:
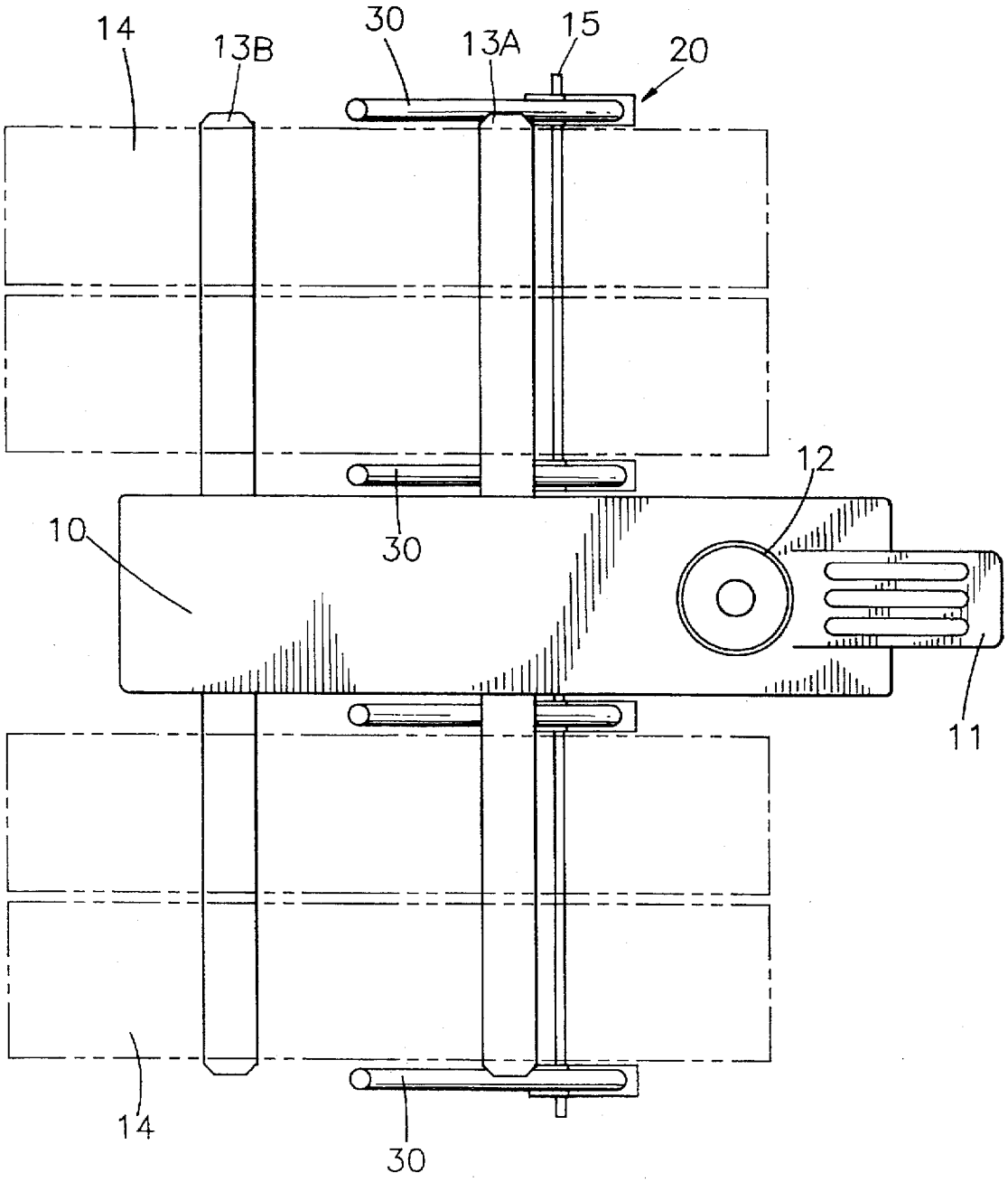
FIG. 2 shows a schematic top view of a thread feeder with a vertically-extendable spool protector according to the present invention.
Figure 3:
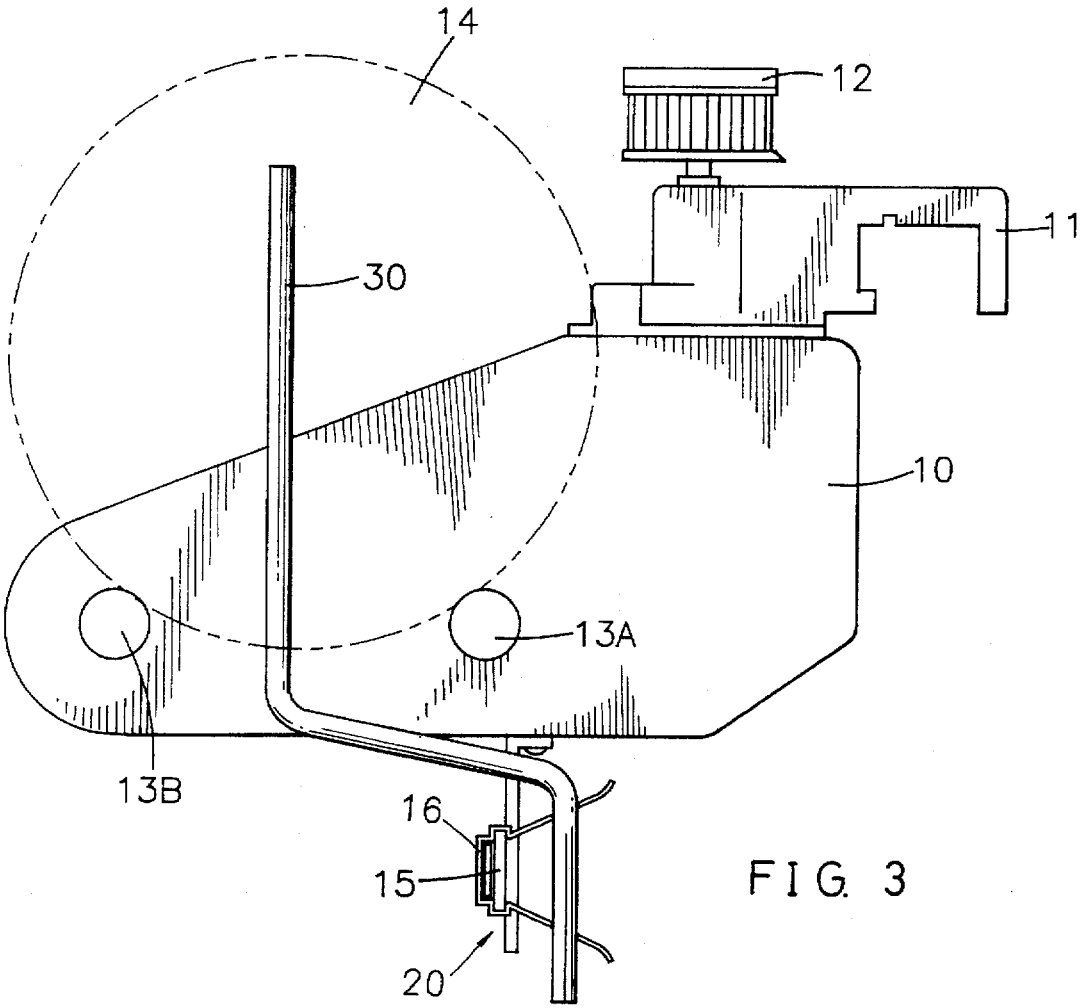
FIG. 3 shows a schematic side view of the thread feeder with a vertically-extendable spool protector according to the present invention.
Figure 4:
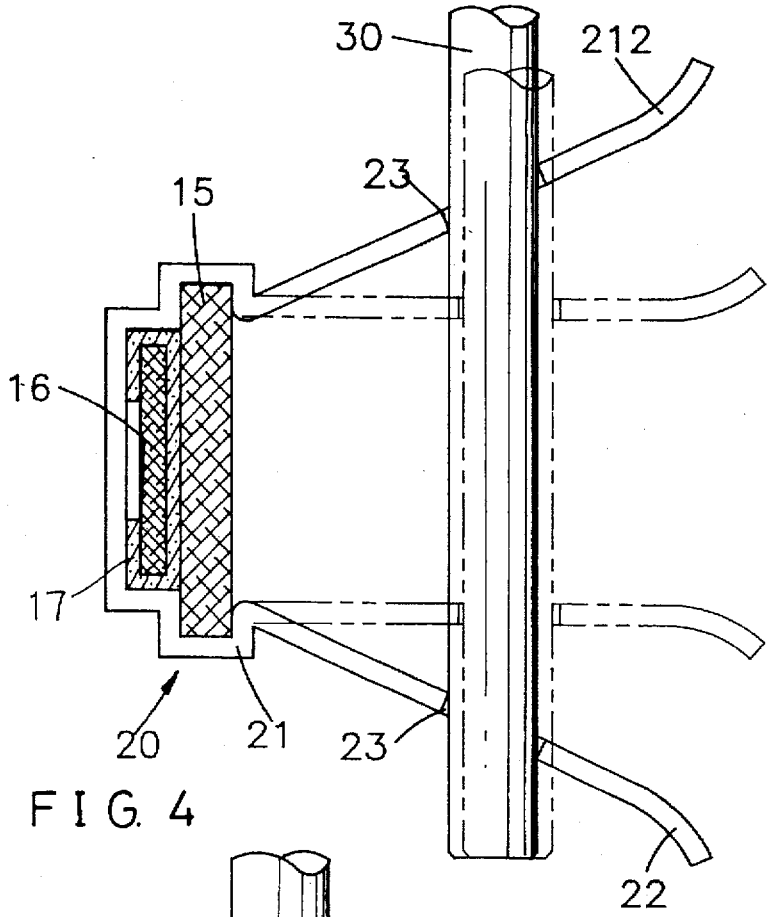
FIG. 4 shows an enlarged view of part of the vertically-extendable spool protector.

Referring to FIGS. 2 through 4, the thread feeder shown includes a base 10, a mount 11 on one end of the base 10, a pulley 12, a pair of rollers 13A, 13B which are driven by a gear box (not shown) inside the base 10 for supporting and driving a spool 14, and a mounting piece 15 which is arranged in parallel to the rollers 13A, 13B. On the mounting piece 15, there are provided with a conductive plate 16 and an insulating member 17 between the mounting piece 15 and the conductive plate 16.

As shown in FIG. 3, the vertically-extendable spool protector of the invention includes a protection beam 30 which is bent into three straight and substantially perpendicularly angled segments and a supportive piece 20 which is substantially U-shaped in cross section. As shown in FIG. 4, the supportive piece 20 has a middle section grasping to a fixed mounting piece 15, and a pair of angled portions 22 each formed with a coupling hole 23 therein. The diameter of the coupling hole 23 is specifically shaped to allow the protection beam 30 to penetrate therethrough. The supportive piece 20 is made of a flexible metal that allows the two angled portions 22 thereof to be restorable to the original angled position after they are forced to bend inwards. To couple the supportive piece 20 to the protection beam 30, the technician can first push forcibly by hand the angled portions 22 of the supportive piece 20 inwards, then penetrate the protection beam 30 through the coupling holes 23 in the angled portions 22, and finally release the angled portions 22. After the angled portions 22 are released, they are restored to the original angled position, allowing the inner wall of the coupling holes 23 therein to urge forcibly against the protection beam 30, thereby securing the supportive piece 20 firmly in position on the protection beam 30,. In other words, the protection beam 30 has its bottom segment secured at the bottom portion of the base 10 by the supportive piece 20 and is extendable from the same upwards so as to allow its upper segment to substantially cover the whole diameter range of the spool 14 being supported on the pair of rollers 13A, 13B, as illustrated in FIG. 3.

By the invention, the protection beam 30 can be adjusted to a suitable position that allows it to provide maximum coverage to the spool 14 (shown in FIG. 3) that is mounted on the rollers 13A, 13B. As described above, the protection beam 30 can be freely adjusted when the angled portions 22 of the supportive piece 20 are pushed inwards by hand. After being freely adjusted to a suitable position, the protection beam 30 can be secured in position by releasing the two angled portions 22 of the supportive piece 20 to their original positions. This operation is very easily achievable by the technician.

Figure 5:
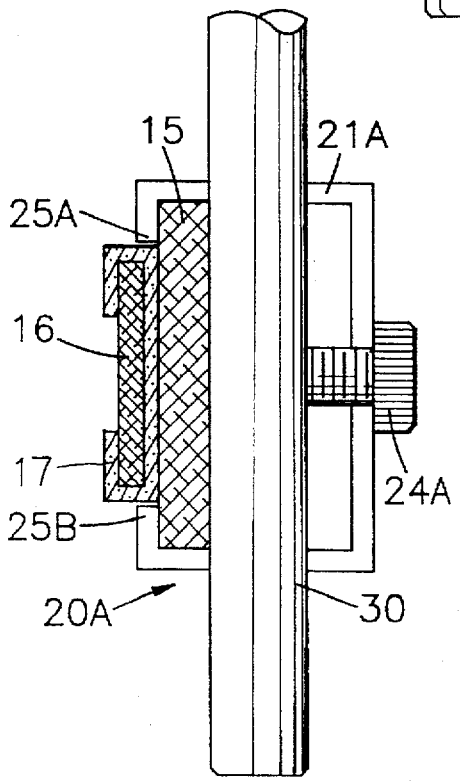
FIG. 5 shows a schematic side view of another embodiment of the vertically-extendable spool protector.

Referring further to FIG. 5, there is shown another preferred embodiment of the vertically-extendable spool protector according to the present invention. In this embodiment, the spool protector includes a substantially C-shaped securing frame 21A and a screw 24A for adjustably securing the protection beam 30 in desired positions. When the screw 24A is tightly fastened, the protection beam 30 is urged forcibly by the tail end of the screw 24A against one side of the mounting piece 15 and thereby firmly secured in position. The securing frame 21A has two free ends 25A, 25B which grasp firmly on the back of the mounting piece 15. To adjust the protection beam 30 to a desired position, the technician needs just to loosen the screw 24A to release the protection beam 30, then adjust the protection beam to the desired position and finally fasten the screw 24A tightly again.

In conclusion, the spool protector of the invention allows the technician to adjust for a suitable position for the protection beam so as to protect spools of various sizes. Further, the adjustment is very easy to achieve.

The invention has been described using exemplary preferred embodiments. However, it is to be understood that the scope of the invention is not limited to the disclosed embodiments. To the contrary, it is intended to cover various modifications and similar arrangements. The scope of the claims, therefore, should be accorded the broadest interpretation so as to encompass all such modifications and similar arrangements.

What is claimed is:

1. A spool protector for protecting at least a spool on a yarn feeder, comprising:

a) a fixed mounting piece installed near a bottom portion of the spool to be protected;

b) a supportive piece fastened to said fixed mounting piece and a securing portion positioned on the supportive piece;

c) a protection beam including an upper segment, a middle segment and a bottom segment, the bottom segment of said protection beam penetrating said securing portion on said supportive piece to be securely locked in position thereby, and the protective beam being extendably vertically upwards to place the upper segment in position for protection of the spool;

d) said securing portion having a first and a second position;

wherein when the securing portion is in the first position a securing means is urged forcibly against the bottom segment of said protection beam such that said protection beam is secured in position; and when the securing portion is in the second position the securing means urges no force against the bottom segment of said protection beam, thereby releasing said protection beam for free vertical adjustment to allow the upper segment of said protection beam to be positioned for protection of the spool.

2. The spool protector of claim 1, wherein the supportive piece is formed of a flexible material, said supportive piece having a middle portion fastened to said fixed mounting piece and a pair of angled portions each being formed with a coupling hole therein, the protecting beam penetrating the coupling holes on the supportive pieces to securely elastically lock the beam in position, when the supportive piece is subject to external force, the coupling holes relax the force against the bottom segment of the supporting beam to allow for vertical movement thereof and when no force is applied to the angled portions of the supportive piece, inner edges of the coupling holes are forced against the support beam to secure the beam in position.

3. The spool protector of claim 1, wherein the supportive piece is a releasably fastening device having a securing frame and a screw mounted on said securing frame, the protection beam being releasably mounted on the releasable fastening device; when the screw is tightened a tail end of the screw forces the protection beam against the fixed mounting piece for securing the beam in position and when the screw is loosened, the protection beam is released for free vertical adjustment.

* * * * *